United States Patent [19]

Guiler

[11] Patent Number: 4,832,387

[45] Date of Patent: May 23, 1989

[54] PADLOCK-TYPE SECURITY SEAL HAVING A LOCKING INSERT FIXED IN A HOLLOW BODY AND METHOD OF MAKING SAME

[75] Inventor: Richard S. Guiler, Newton, N.J.

[73] Assignee: E. J. Brooks Company, Newark, N.J.

[21] Appl. No.: 184,041

[22] Filed: Apr. 20, 1988

[51] Int. Cl.[4] ..... B65D 33/34

[52] U.S. Cl. ..... 292/320

[58] Field of Search ..... 292/312, 318–322, 292/326

[56] References Cited

U.S. PATENT DOCUMENTS

| | | | |
|---|---|---|---|
| 503,110 | 8/1893 | Denney | 292/320 |
| 998,878 | 7/1911 | Dinsmoor | 292/320 |
| 1,688,739 | 10/1928 | Moore | 292/318 |
| 3,980,332 | 9/1976 | King, Sr. | 292/317 |
| 4,687,240 | 8/1987 | Swift | 292/320 |
| 4,733,893 | 3/1988 | Davis et al. | 292/320 |

*Primary Examiner*—Richard E. Moore

*Attorney, Agent, or Firm*—John G. Gilfillan, III

[57] ABSTRACT

A padlock type security seal and method of making same including a U-shaped shackle, a pair of reversely bent end portions, and a body portion having a pair of chambers for receiving the bent end portions. The chambers each have a locking groove therein for receiving the bent end portions. The seal elements are designed from two molded pieces, an insert and a body. The relative dimensions of the chambers, the shackle, and the locking grooves are chosen to prevent picking.

9 Claims, 1 Drawing Sheet

PADLOCK-TYPE SECURITY SEAL HAVING A LOCKING INSERT FIXED IN A HOLLOW BODY AND METHOD OF MAKING SAME

BACKGROUND OF THE INVENTION

The present invention relates to a high security seal of the padlock type and, more particularly, to a seal having a wire shackle that is first threaded through a structure to be secured and then locked in a seal body such that the seal must be broken to be opened. The present invention also relates to a method of making such seals.

Security seals of the padlock type are generally well known, and they have found wide spread use for sealing structures such as currency bags, closures, electric meters, and the like. Examples of such seals may be found in the following U.S. Patents: U.S. Pat. Nos. 3,485,461; 3,373,033; 3,980,332; 4,353,583; 4,278,281; and 4,687,240.

All of these seals have, generally, a plastic body with a pair of spaced cavities in which a U-shaped shackle is permanently locked. Locking the shackle is typically accomplished by a pair of reversely bent, resilient legs that register with a bump or depression located in the spaced cavities. Although such devices have served the purpose, they have not provided entirely satisfactory, because some efforts to defeat such structures by picking have proved successful. Those concerned with the development of such security seals have long recognized the need for providing such seals with improved anti-picking characteristics. For example, the above-cited U.S. Pat. No. 3,375,033 shows a special shackle having means specifically provided to discourage picking by making it difficult to insert a picking tool into the body cavity. However, even though such efforts have proved successful, some seal picking persists. One such method of picking involves inserting a picking tool into the seal body and deforming the shackle legs to an extent that the legs can freely be withdrawn from the seal body, reformed, and later replaced in the seal body.

SUMMARY OF THE INVENTION

It is, therefore, an object of the present invention to provide a high security seal that resists picking.

Another object of the invention is to provide a plastic seal that can be economically molded and assembled with standard manufacturing equipment.

In accordance with the present invention, there is provided a padlock type security seal including a U-shaped shackle, having a pair of reversely bend end portions, and a body portion having a pair of chambers for receiving the bent end portions. The chambers each have a locking groove therein for receiving the bent end portions. Picking the present seal by deforming the shackle to remove the bent end portions from the chamber is virtually impossible without simultaneously causing detectable damage to the sal body. Additionally, the seal elements are so designed that they can be molded and assembled economically in accordance with standard manufacturing practices.

The exact nature of this invention, as well as other objects and advantages thereof, will be readily apparent from consideration of the following specifications relating to the annexed drawings in which:

DETAILED DESCRIPTION OF THE PREFERRED EMBODIMENT

Figure 1:
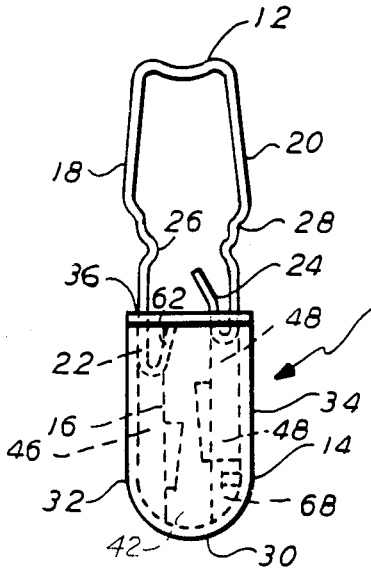
FIGS. 1–3 are plan views of the preferred embodiment.

Referring now to the drawings, there is shown a security seal 10 having a resilient shackle 12, a seal body 14, and an insert 16. The resilient shackle 12, formed of spring wire, is generally U-shaped with a long leg 18 and a short leg 20. Legs 18 and 20 have reversely bent end portions 22 and 24, respectively. Legs 18 and 20 are also formed with anti-picking bumps 26 and 28, respectively.

The seal body 14 is made of molded plastic that forms a flat, generally rectangular box having a narrow curved bottom wall 30, two parallel narrow side walls 32 and 34, and a narrow top wall 36 with an opening 38 therein. The narrow walls 30, 32, 34 and 36 are joined by broad side walls 40 and 42 to define a narrow hollow interior. The hollow interior consists of parallel side channels 46 and 48 of equal thickness joined by a thicker central channel 50.

Insert 16 has an elongated body 60 with overall dimensions substantially equal to the dimensions of channel 50. A first tapered groove 62 is formed in a side and near one end of the insert 16. A second tapered groove 64 is formed in the same side as groove 62 but near the opposite end of the inset 16. A third tapered groove 66 is formed in the side of insert 16 opposite to the side containing grooves 62 and 64. Groove 66 is located medially of the ends of insert 16. A stop flange 68 is formed on insert 16 between the end of groove 66 and the end of insert 16.

The thickness of the wire that forms shackle 12, the thickness of side channels 46 and 48, and the width of grooves 62, 64 and 66 are all equal and designated in the drawings by the letter (a). The unstressed widths of the reversely bent end portions 22 and 24 are equal and designated by the letter (b). The widths of channels 46 and 48 are equal and designated by the letter (c). The maximum depth of the grooves 64 and 66 are equal and designated by the letter (d).

Figure 2:
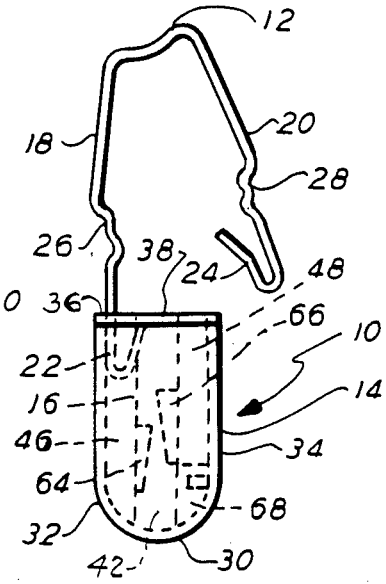
Figure 3:
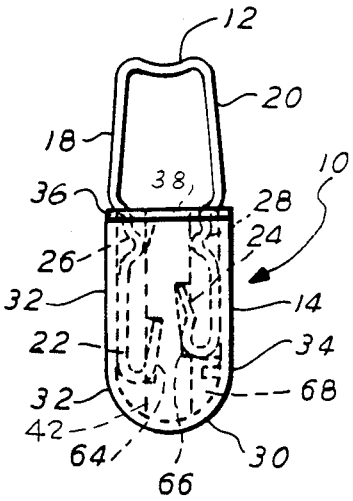
Figure 4:
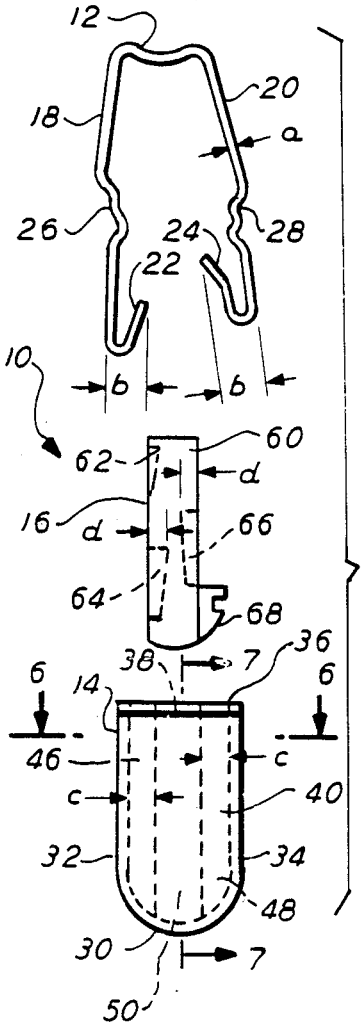
FIG. 4 is an exploded view of the devise shown in FIGS. 1–3.
Figure 5:
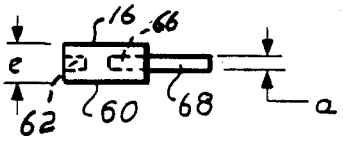
FIGS. 5 and 6 are top views of parts of the preferred embodiment.
Figure 6:
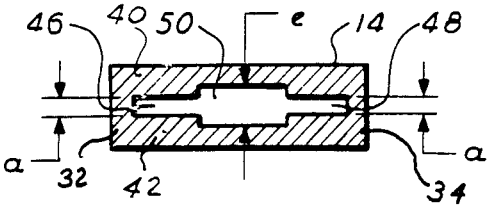
Figure 7:
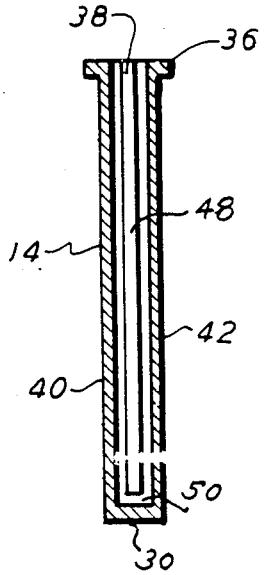
FIG. 7 is a side elevation view of a part of the preferred embodiment.

The operation of the seal 10 is as follows. The seal 10 is shipped in the position shown in FIG. 1, i.e., with the reversely bent end portion 22, on long leg 18, inserted in channel 46 and mating with groove 62 to hold the shackle 12 in place. A small portion of the reversely bent end portion 24 on leg 20 in inserted in channel 48. In this position, the seal 10 is said to be closed. When it is desired to seal a structure, the seal 10 is opened to the position shown in FIG. 2 by removing the short leg 20 from channel 48 and threading it through the structure to be sealed. The short leg 20 is then replaced in channel 48 and the seal 10 is locked by pushing the shackle 12 into the channels 46 and 48 until both legs 18 and 20 have their reversely bent end portions 22 and 24 locked in grooves 64 and 66, respectively, as shown in FIG. 3. During this locking operation, the reversely bent end portions 22 and 24 are compressed by the walls of the channels 46 and 48. Such compression does not exceed the elastic limit of the material of the shackle. Thus, when the end portions 22 and 24 are fully inserted, they expand and snap into grooves 64 and 66, respectively.

The ideal relative dimensions for the various parts are as follows. The unstressed width (b) of the reversely bent end portions 22 and 24 should be greater than (c+d), i.e., the sum of the widths of the respective channels 46 and 48 plus the maximum depth of grooves 64 and 66, respectively. Additionally, the elastic characteristics of the wire shackle 12 should be such that end portions 22 and 24 are not significantly deformed during insertion in the channels 46 and 48 so that, in the locked position, the end portions 22 and 24 remain slightly compressed against the tapered bottom of grooves 64 and 66. Further, the widths (c) of channels 46 and 48 should be only slightly larger than twice the width (a) of the wire of the shackle 12.

The above dimensions, considered ideal but not limiting, are chosen so that the structure will inherently resist picking of the seal 12. For example, if (c), the widths of channels 46 and 48, is only slightly larger than (*2a*), twice the width of the shackle 12 wire, then there will be little room in channels 46 and 48 for a picking tool to be used to withdraw the reversely bent end portions 22 and 24. Also, the end portions 22 and 24 will not be suspectible to deformation while in grooves 64 and 66 if they are resilient enough to be first compressed to a width (c) and then permitted to snap back to assume an unstressed width greater than (c+d). Also, since the depth (d) of grooves 64 and 66 is greater than the width (c) of channels 46 and 48, then a picking tool cannot bend the end portions 22 and 24 by an amount equal to or less than (c) by squeezing the end portions 22 and 24 against the tapered bottoms of grooves 64 and 66. In order to successfully withdraw the legs from the present seal with these dimensions, the end portions 22 and 24 must be permanently bent to a dimension equal to or less than (c). As mentioned above, the ideal dimension for (c) is slightly more than twice the thickness of the wire of shackle 12. Therefore, to successfully pick the present seal one would have to virtually completely deform end portions 22 and 24. Clearly, to accomplish that task one would have to risk significant damage to the seal body 14.

The construction of the insert 16 and the channel 50 has also been chosen to resist picking. The thickness (e) of channel 50 and insert 16 is greater than, the thickness (a) of side channels 46 and 48 and the wire of shackle 12. The grooves 64 and 66 are formed in the insert 16 with the necessary thickness (a) while having no cracks or joints in the grooves 64 and 66; hence, entrance to grooves 64 and 66, without deforming the insert 16, is possible only through the openings of groove 64 and 68.

Clearly, the dimensions described above are ideal and those skilled in the art will recognize other options. For example, some permanent deformation of the end portions 22 and 24 is permissible as long as the unstressed width (b) after locking is greater than (c), and the depth (d) of grooves 64 and 66 is not so same that a picking tool could permanently deform the end portions 22 and 24 to a size equal to or less than (c).

The present seal body 14 and insert 16 may be manufactured inexpensively using standard plastic molding techniques and equipment. As can be seen from the figures, seal body 14 and insert 16 may be made using only positive molds. For example, seal body 14, formed in the shape of a cup having side walls, a bottom wall, and a top opening, can be formed conveniently with a positive plastic mold, i.e., the mold elements move only in one linear direction when the mold is opened. For example, the die forming the outside surface of seal body 14 and the plunger forming the inside surfaces of channels 46, 48 and 50, need only be moved in one liner direction to withdraw the plunger from the channels 46, 48 and 50, and to withdraw the seal body 14 from the die. The same situation is also possible for the molding of insert 16. A positive mold may be employed; therefore, the die may be used to form the outside surfaces of the body 60 and flange 68 and the inside of groove 66, while the plunger forms the grooves 62 and 64 and the surface on body 60 containing grooves 62 and 64. No negative mold elements must be involved.

The insert 16 is formed as a fairly rigid beam-like structure having smooth continuous surfaces thereby making it ideally suited for easy assembly by sliding it through the opening 38 into central channel 50 in seal body 14. The stop flange 68 is dimensioned to snugly slide into channel 40 as the insert 16 is assembled. The insert 16, after inserting may be conveniently secured in seal body 14 by any standard means: for example, an ultrasonic weld applied to the exterior of seal body 14 in the area adjacent insert 18 can permanently join these parts.

Various modifications are contemplated and may obviously be resorted to by those skilled in the art without departing from the spirit and scope of the invention, as hereinafter defined by the appended claims, as only a preferred embodiment thereof has been disclosed.

What is claimed is:

1. A security seal comprising:

a U-shaped resilient shackle having first and second legs and having a reversely bent end portion;

a cup-shaped hollow seal body having an aperture in one side thereof;

an insert fixed in the hollow interior of said hollow seal body;

said insert and said hollow seal body defining elongated first and second chambers contiguous with said aperture;

said insert having first and second cup-shaped grooves on opposed sides thereof;

each said first and said second groove having contiguous bottom and side walls defining an opening with a continuous perimeter formed in the surface of said insert contiguous with a different one of said elongated chambers; and the thickness of said shackle and said elongated chambers and said groove being substantially equal.

2. A security seal as defined in claim 1 and wherein said reversely bent end portion has a width greater than the width of said elongated chamber.

3. A security seal as defined in claim 2 and wherein the width of said elongated chamber is slightly greater than twice the thickness thereof.

4. A security seal as defined in claim 2 and wherein said width of said reversely bent end portion is greater than the width of said elongated chamber plus the depth of said groove.

5. A security seal as defined in claim 4 and wherein the width of said elongated chamber is slightly greater than twice the thickness thereof.

6. A security seal according to claim 5 and wherein the length of said groove is substantially equal to the length of said reversely bent end portion.

7. A security seal according to claim 6 and wherein one of said side walls of said groove is adjacent the end of said elongated chamber.

8. A method making a molded plastic security seal body for use with a resilient shackle comprising:

molding a seal body into a cup-shaped vessel having a narrow opening;

molding an insert having a thickness equal to the thickness of said narrow opening and having at least one cup-shaped groove therein having contiguous bottom and side walls and an opening;

inserting said insert into said sealed body through said narrow elongated opening to form a channel in said seal body with said opening being contiguous with said channel and being equal in width to the width of said channel; and securing said insert to said seal body.

9. A method making a molded plastic security seal body for use with a resilient shackle comprising:

molding a seal body into a cup-shaped vessel having a narrow elongated openings;

molding an elongated insert having a thickness equal to the thickness of said narrow opening of said narrow elongated opening and having opposed grooves on opposite sides thereof each having continguous bottom and side walls and an opening;

inserting said insert into said seal body through said narrow elongated opening to form opposed channels in said seal body with said openings being contiguous with and equal in width to a different one of said channels; and securing said insert to said seal body.

* * * * *

UNITED STATES PATENT AND TRADEMARK OFFICE

CERTIFICATE OF CORRECTION

PATENT NO. : 4,832,387

DATED : May 23, 1989

INVENTOR(S) : Richard S. Guiler

It is certified that error appears in the above-identified patent and that said Letters Patent is hereby corrected as shown below:

Column 1, line 61, "sal" should read --seal--.

Column 2, line 35, "inset" should read --insert--.

Column 3, line 59, "same" should read --small--.

Column 4, line 22, "inserting" should read --insertion,--.

Column 4, line 25, "insert 18" should read --insert 16--.

Signed and Sealed this

Tenth Day of April, 1990

*Attest:*

HARRY F. MANBECK, JR.

*Attesting Officer*

*Commissioner of Patents and Trademarks*